US009412306B2

(12) United States Patent
Kim

(10) Patent No.: US 9,412,306 B2
(45) Date of Patent: Aug. 9, 2016

(54) DRIVING APPARATUS AND DISPLAY DEVICE INCLUDING THE SAME

(71) Applicant: Samsung Display Co., Ltd., Yongin (KR)

(72) Inventor: Mi-Hae Kim, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 66 days.

(21) Appl. No.: 14/203,043

(22) Filed: Mar. 10, 2014

(65) Prior Publication Data

US 2015/0015554 A1 Jan. 15, 2015

(30) Foreign Application Priority Data

Jul. 9, 2013 (KR) ..... 10-2013-0080555

(51) Int. Cl.
*G09G 3/32* (2016.01)

(52) U.S. Cl.
CPC ..... *G09G 3/3266* (2013.01); *G09G 3/3208* (2013.01); *G09G 2300/0861* (2013.01); *G09G 2310/0286* (2013.01)

(58) Field of Classification Search
CPC ..... G09G 3/3291; G09G 2300/0426; G09G 2300/08
See application file for complete search history.

(56) References Cited

U.S. PATENT DOCUMENTS

2007/0001953 A1* 1/2007 Jang et al. ..... 345/88
2008/0012818 A1* 1/2008 Lee et al. ..... 345/100
2012/0287099 A1* 11/2012 Toyotaka ..... 345/209

FOREIGN PATENT DOCUMENTS

KR 10-2010-0082514 7/2010
KR 10-2012-0044784 5/2012
KR 10-2012-0094734 8/2012

* cited by examiner

*Primary Examiner* — Sahlu Okebato
(74) *Attorney, Agent, or Firm* — Cantor Colburn LLP

(57) ABSTRACT

A driving apparatus includes: a plurality of shift registers disposed at a plurality of stages, respectively, where each of the shift registers includes: a first driver which generates an intermediate output signal and a first output signal based on a first signal, where the first driver includes: an input signal terminal, to which the first signal is applied; and an inversion input signal terminal, to which a second signal, which is an inverted signal of the first signal, is applied; and a second driver which receives the first output signal and generates a second driver output signal having a pulse voltage at a first level based on the first output signal and a pulse voltage at a second level based on a first clock signal or a second clock signal.

36 Claims, 6 Drawing Sheets

DRIVING APPARATUS AND DISPLAY DEVICE INCLUDING THE SAME

This application claims priority to Korean Patent Application No. 10-2013-0080555, filed on Jul. 9, 2013, and all the benefits accruing therefrom under 35 U.S.C. §119, the content of which in its entirety is herein incorporated by reference.

BACKGROUND (a) Field

Exemplary embodiments of the invention relate to a driving apparatus and a display device including the driving apparatus.

(b) Description of the Related Art

An organic light emitting diode ("OLED") display is a type of flat panel display that displays an image using an OLED emitting light by the recombination of electrons and holes. The OLED display typically has fast response speed, low power consumption, superior luminous efficiency, superior luminance and a wide viewing angle.

A display panel of a flat panel display typically includes a plurality of pixels arranged in a matrix pattern, a data signal is selectively transferred to a pixel by scan lines and data lines connected to each pixel, and light emission is controlled based on a light emission control signal transferred through a light emission control line connected to each pixel so that the flat panel display displays the image.

The flat panel display typically includes a driving circuit to generate and transfer various signals such as a scan signal, a gate signal and a light emission control signal to control a display operation, and the driving circuit typically occupies a large area in a layout design of a display device.

SUMMARY

Exemplary embodiments provide a driving apparatus and a display device including the driving apparatus with reduced dead space in a driving circuit thereof and with reduced driving circuit area thereof, where the display device is a high resolution display device.

An exemplary embodiment provides a driving apparatus including a plurality of shift registers disposed at a plurality of stages, respectively, where each of the shift registers includes: a first driver which generates an intermediate output signal and a first output signal based on a first signal, where the first driver includes: an input signal terminal, to which the first signal is applied; and an inversion input signal terminal, to which a second signal, which is an inverted signal of the first signal, is applied; and a second driver which receives the first output signal and generates a second driver output signal having a pulse voltage at a first level based on the first output signal and a pulse voltage at a second level based on a first clock signal or a second clock signal.

In an exemplary embodiment, a pulse signal of the intermediate output signal and a pulse signal of the first output signal may be inverted to each other, and the pulse voltage of the first output signal may be substantially equal to the pulse voltage of the first signal.

In an exemplary embodiment, the first signal may include a first input signal, a second input signal, a first inversion, which is an inverted signal of the first input signal, and a second inversion input signal, which is an inverted signal of the second input signal, and the first input signal, the second input signal, the first inversion input signal and the second inversion input signal may be input to input signal terminals of four consecutive stages of the shift registers, respectively.

In an exemplary embodiment, inversion input signal terminals of the four consecutive stages of the shift registers may receive the first inversion input signal, the second inversion input signal, the first input signal and the second input signal, respectively.

In an exemplary embodiment, the intermediate output signal of a shift register at a stage of the stages may be transferred to a first driver of a shift register at a second next stage of the stages in a forward drive of the shift registers.

In an exemplary embodiment, the intermediate output signal of a shift register at a stage of the stages may be transferred to a first driver of a shift register at a second previous stage of the stages in a backward drive of the shift registers.

In an exemplary embodiment, the first level may be a predetermined high level, and the second level may be a predetermined low level.

In an exemplary embodiment, the second driver output signal may include: a second output signal having the pulse voltage at the second level based on one of the first clock signal and the second clock signal; and a third output signal having the pulse voltage at the second level based on the other of the first clock signal and the second clock signal.

In an exemplary embodiment, the second output signal of a shift register at a stage of the stages may be transferred to the second driver of a shift register at a next stage of the stages in a forward drive of the shift registers.

In an exemplary embodiment, the second output signal of a shift register at a stage of the stages may be transferred to the second driver of a shift register at a previous stage of the stages in a forward drive of the shift registers.

In an exemplary embodiment, a first control signal, which controls a forward drive of the shift registers, may be input to the first driver, and a second control signal, which controls a backward drive of the shift registers and is an inverted signal of the first control signal, may be input to the second driver.

In an exemplary embodiment, the first output signal may control the pulse voltage at the first level of the second driver output signal, and have a voltage level corresponding to a gate-on voltage level of a transistor in the second driver.

In an exemplary embodiment, the first driver may further include a first control signal terminal to which a first control signal, which controls control a forward drive of the shift registers, is applied, a second control signal terminal to which a second control signal, which controls a backward drive of the shift registers, is applied, a first forward driving signal terminal to which a first forward start signal of the first driver or the intermediate output signal at a second previous stage is applied, and a first backward driving signal terminal to which a backward start signal of the first driver or the intermediate output signal at a second next stage is applied.

In an exemplary embodiment, the second driver may include a first clock signal clock terminal to which one of the first clock signal and the second clock signal is applied, a second clock signal terminal to which the other of the first clock signal and the second clock signal is applied, the first control signal terminal, the second control signal terminal, a second forward driving signal terminal to which the forward start signal of the first control signal terminal or an output signal of the second driver at a first previous stage is applied, and a second backward driving signal to which the backward start signal of the second driver or an output signal of the second driver at a next stage is applied.

In an exemplary embodiment, the first driver may further include a retain signal terminal to which a retain signal, which controls a transfer of a predetermined bias voltage to a gate electrode of a transistor of the first driver, is applied.

In an exemplary embodiment, the predetermined bias voltage may include a power source voltage with a high potential or a low potential.

In an exemplary embodiment, the first driver may further include: a first switch which transfers a pulse voltage of the forward start signal of the first driver or the intermediate output signal at the second previous stage based on the first control signal; a second switch which transfers a pulse voltage of the backward start signal of the first driver or the intermediate output signal at the second next stage based on the first control signal; a third switch connected to a first common node to which the first switch and the second switch are connected and which transfers a signal applied to the first common node to a first node based on the first signal; a fourth switch which transfers a first power source voltage at a predetermined high potential to a second node based on the first signal; a fifth switch which transfers the pulse voltage of the second signal to the second node based on the voltage transferred to the first common node; a sixth switch which transfers the first power source voltage to a third node based on the voltage transferred to the second node; a seventh switch which transfers a second power source voltage at a predetermined low potential to the third node based on the first signal; an eighth switch which transfers the first power source voltage to a fourth node based on the voltage transferred to the third node; a ninth switch which transfers the second power source voltage to the fourth node based on the voltage transferred to the second node; a tenth switch which transfers the first power source voltage to a fifth node based on the voltage transferred to the fourth node; an eleventh switch which transfers the second power source voltage to the fifth node based on the voltage transferred to the third node; a first capacitor connected between the first node and the second node; and a second capacitor connected between the third node and the fifth node.

In an exemplary embodiment, the first driver may further include an intermediate output signal terminal connected to the fourth node and which outputs the intermediate output signal of the first driver.

In an exemplary embodiment, the first driver may further include at least one of a twelfth switch which transfers the first power source voltage to the first node based on a retain signal, a thirteenth switch which transfers the second power source voltage to the second node based on the retain signal, and a fourteenth switch which transfers the first power source voltage to the fifth node based on the retain signal.

In an exemplary embodiment, the second driver may include: a fifteenth switch which transfers a pulse voltage of the forward start signal of the second driver or the second driver output signal of the second driver at the first previous stage based on the first control signal; a sixteenth switch which transfers a pulse voltage of the backward start signal of the second driver or the second driver output signal of the second driver at the first next stage based on the second control signal; a seventeenth switch connected to a second common node, to which the fifteenth switch and the sixteenth switch are connected, and which transfers a voltage applied to the second common node to a sixth node based on the clock signal applied to the first clock signal terminal; an eighteenth switch which transfers the first power source voltage at a predetermined high potential to a seventh node based on the first output signal output from the first driver; a nineteenth switch which transfers the pulse voltage of the clock signal applied to the second clock signal terminal to the seventh node based on the voltage transferred to the sixth node; a twentieth switch which transfers the voltage transferred to the seventh node to an eighth node based on the clock signal applied to the second clock signal; a twenty-first switch which transfers the first power source voltage to the ninth node based on the first output signal output from the first driver; a twenty-second switch which transfers a pulse voltage of the clock signal applied to the first clock signal to a ninth node based on the voltage transferred to the eighth node; a third capacitor connected between the sixth node and the seventh node; and a fourth capacitor connected between the eighth node and the ninth node.

In an exemplary embodiment, the second driver may further include an output signal terminal connected to the seventh node and which outputs the second driver output signal having the pulse voltage at the second level based on the first clock signal.

In an exemplary embodiment, the second driver may further includes an output signal terminal connected to the seventh node and which outputs the second driver output signal having the pulse voltage at the first level and the pulse voltage at the second level based on to the first clock signal, and the pulse voltage of the second driver output signal at the first level may be generated from the eighteenth switch.

In an exemplary embodiment, the second driver may further include an output signal terminal connected to the ninth node and which outputs the second driver output signal having the pulse voltage at the second level based on the second clock signal.

In an exemplary embodiment, the second driver may further include an output signal terminal connected to the seventh node and which outputs the second driver output signal having the pulse voltage at the first level and the pulse voltage at the second level based on to the second clock signal, and the pulse voltage of the second driver output signal at the first level may be generated from the twenty-first switch.

Another exemplary embodiment provides a display device including: a display unit including a plurality of first gate lines to which a plurality of first gate signals are transferred, a plurality of second gate lines to which a plurality of second gate signals are transferred, a plurality of light emission control lines to which a plurality of light emission control signals are transferred, a plurality of data lines to which a plurality of data signals are transferred, and a plurality of pixels connected to the first gate lines, the second gate lines, the light emission control lines and the data lines; an integral driver which generates and transfers the first gate signals, the second gate signals and the light emission control signals to the pixels, respectively; a data driver which generates and transfers the data signals to the data lines; and a timing controller which controls the integral driver and the data driver, where the integral driver includes a plurality of shift registers, where each of the shift registers includes: a first driver which generates an intermediate output signal and a first output signal based on a first signal from the timing controller, where the first driver includes: an input signal terminal, to which the first signal is applied; and an inversion input signal terminal, to which a second signal, which is an inverted signal of the first signal, is applied; and a second driver which receive the first output signal and generates a first gate signal, which corresponds thereto among the first gate signals, and a second gate signal, which corresponds thereto among the second gate signals, where each of the first gate signal and the second gate signal has a pulse voltage at a first level controlled based on the first output signal and a pulse voltage at a second level based on a first clock signal or a second clock signal.

According to exemplary embodiment of the invention, the number of circuit devices of the driving apparatus is substantially reduced, and a driving apparatus area is substantially reduced by reducing a dead space in a driving circuit.

In such embodiments, the display device including the driving apparatus having reduced number of circuit devices may effectively display an image of high resolution by precisely and efficiently generating various signals to control display operation of the display device.

BRIEF DESCRIPTION OF THE DRAWINGS

The above and other features of the invention will become more apparent by describing in detail exemplary embodiments thereof with reference to the attached drawings, in which.

DETAILED DESCRIPTION

Figure 1:
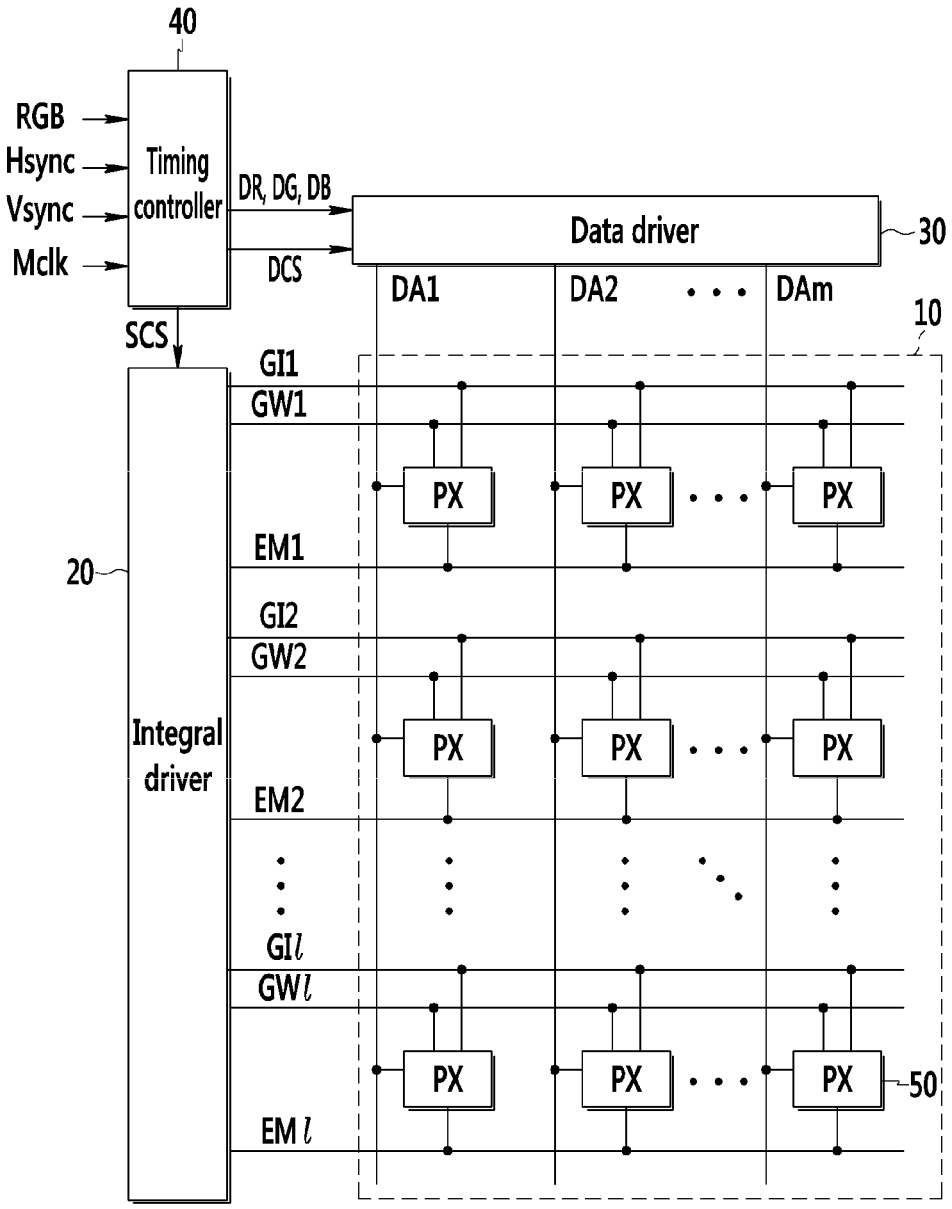
FIG. 1 is a block diagram illustrating an exemplary embodiment of a display device according to the invention.

The invention will be described more fully hereinafter with reference to the accompanying drawings, in which exemplary embodiments of the invention are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on," "connected to" or "coupled to" another element or layer, the element or layer can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims set forth herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Hereinafter, exemplary embodiments of the invention will be described in further detail with reference to the accompanying drawings FIG. 1 is a block diagram illustrating an exemplary embodiment of a display device according to the invention.

Referring to FIG. 1, the display device in FIG. 1 includes a display unit 10, an integral driver 20, a data driver 30 and a timing controller 40. In such an embodiment, the display device includes the integral driver 20 to generate at least two driving signals (e.g., scan signal and light emission control signal), which are transferred to respective pixels of the display unit to drive the pixels.

In such an embodiment, the driving apparatus may be an integral driver to perform a display operation of the display device, and to generate and transfer at least two types of the driving signals including a pulse having a predetermined period, but the invention is not limited thereto.

In an exemplary embodiment, the display device includes a flat panel display. In an exemplary embodiment, the display device may include any type of display device, such as a liquid crystal display ("LCD") and an organic light emitting diode ("OLED") display, for example, but the invention is not limited thereto.

In an exemplary embodiment, the integral driver 20 includes a scan driver that generates and transfers a driving signal (for example, a scan signal) for selecting and operating a plurality of pixels of the display unit 10 and a light emission control driver that generates and transfers a light emission control signal for controlling light emission of the plurality of pixels.

In an exemplary embodiment, as shown in FIG. 1, the display unit 10 includes a plurality of pixels 50 arranged substantially in a matrix form. In such an embodiment, the pixels are connected to a plurality of first gate lines GI1 to GIl, a plurality of second gate lines GW1 to GWl, a plurality of light emission control lines EM1 to EMl, and a plurality of data lines DA1 to DAm. Here, l and m are natural numbers equal to or greater than 2. In one exemplary embodiment, for example, the pixels may be disposed in a pixel area defined by the first and second gate lines, the light emission control lines and the data lines.

In such an embodiment, each pixel 50 is connected to a corresponding first gate line among the first gate lines Gl1 to Gll, a corresponding second gate line among the second gate lines GW1 to GWl, a corresponding light emission control line among the light emission control lines EM1 to EMl, and a corresponding data line among the data lines DA1 to DAm.

In an exemplary embodiment, each of the first gate lines Gl1 to Gll, the second gate lines GW1 to GWl and the light emission control lines EM1 to EMl may extend substantially in a pixel row direction, and arranged substantially parallel to each other. In such an embodiment, the data lines DA1 to Dam may extend substantially in a column direction and arranged substantially parallel to each other. However, the arrangement of the signal lines is not limited thereto, but the arrangement of the signal lines may be variously modified in an alternative exemplary embodiment.

In FIG. 1, the circuit arrangement of each pixel 50 is not shown for convenience of illustration. In an exemplary embodiment, each of the plurality of pixels may include a driving transistor (not shown) as a driving unit thereof and an OLED (not shown) as an emissive element thereof.

In an exemplary embodiment, each of the pixels may further include switches that receive corresponding driving signals transferred from a first gate line, a second gate line and the light emission control line, which connected to the integral driver 20, and is thereby turned-on. Each of the pixels includes a switch to transfer an image data signal thereto, and may receive a scan signal, which is transferred to the switch to control switching operation thereof, as the driving signal.

In an exemplary embodiment, each of the pixels may include a light emission control device to control the OLED to emit light with a driving current corresponding to the image data signal, and may receive a light emission control signal transferred to the light emission control device thereof to control light emission therefrom.

In one exemplary embodiment, for example, each of the pixels may have a circuit arrangement of six transistor-one capacitor ("6TR-1Cap") including at least six transistors with a transistor controlled by a first gate signal transferred through the first gate line and a second gate signal (e.g., a scan signal) transferred through the second gate line, and the capacitor, but the invention is not limited thereto.

In one exemplary embodiment, for example, a pixel 50 of the pixels 50 in the display unit 10 may be selected, e.g., turned on or activated, by the second gate signal (scan signal) transferred through a corresponding second gate line among the second gate line GW1 to GWl, and the driving transistor in the selected pixel 50 receives a data voltage corresponding to an image data signal transferred through a corresponding data line of the data lines DA1 to DAm and supplies a current corresponding to the data voltage to the OLED of the selected pixel 50 to emit light having luminance corresponding to the current. In such an embodiment, the light emission of the OLED of the pixel 50 is controlled by the current flowing through the OLED based on a light emission control signal transferred through a corresponding light emission control line among the light emission control line EM1 to EMl. In such an embodiment, the pixel 50 may initialize a voltage corresponding to a data signal written in a previous frame based on the first gate signal transferred through a corresponding first gate line among a plurality of the first gate lines Gl1 to Gll or reset a voltage for driving the driving transistor. In an alternative exemplary embodiment, the pixel 50 may transfer or move a voltage corresponding to a data signal written and stored in a previous frame to another node based on the first gate signal.

As described above, the pixel 50 may include various circuit devices and may perform various operations using the driving signals transferred from the integral driver 20 based on the number or connection of the circuit devices thereof.

A circuit arrangement and operation of the integral driver 20 will be described in greater detail with reference to FIGS. 2 to 6.

In an exemplary embodiment, as shown in FIG. 1, the integral driver 20 is connected to the second gate lines GW1 to GWl and transfers the second gate signal generated therein to the second gate lines GW1 to GWl. The second gate signal may be a scan signal to activate each pixel, but the invention is not limited thereto. In an alternative exemplary embodiment, the first gate signal may be a scan signal.

In an exemplary embodiment, when a predetermined pixel row is selected in the display unit 10 by the second gate signal, a data signal corresponding to each pixel in the predetermined pixel row is transferred through a corresponding data line connected thereto.

The integral driver 20 is connected to the first gate lines Gl1 to Gin, and transfers the first gate signal generated to the first gate lines Gl1 to Gll. In an exemplary embodiment, the first gate signal may be a signal to control a circuit device for transferring a voltage corresponding to a data signal stored in a previous frame to a gate terminal of the driving transistor or to control a circuit device for initializing or resetting the pixel.

In an exemplary embodiment, the integral driver 20 is connected to a plurality of light emission control lines EM1 to EMl, and transfers a light emission control signal generated therein to the light emission control lines EM1 to EMl. In such an embodiment, the light emission control signal is a signal to control a circuit device disposed between the driving transistor of the pixel and the organic light emitting element (e.g., OLED) to control light emission of the organic light emitting element by controlling a driving current from the driving transistor to the organic light emitting element.

An operation of generating and transferring a driving signal to the display unit by the integral driver 20 is controlled by a control signal SCS transferred from a timing controller 40.

The integral driver 20 may control pulse widths of the first gate signal, the second gate signal and light emission control signal based on the control signal SCS transferred from the timing controller 40. In such an embodiment, pulse voltage levels of light emission control signals to be transferred to the pixels may be simultaneously controlled or sequentially controlled on a pixel row-by-pixel row basis such that a light emitting scheme of the display unit 10 may be controlled in various light emitting modes, e.g., a simultaneous light emitting mode or a sequential light emitting mode.

In an exemplary embodiment, the integral driver 20 may be implemented by a p-type metal-oxide-semiconductor ("PMOS") transistor or an n-type metal-oxide-semiconductor ("NMOS") transistor. The integral driver 20 may be provided on a substrate on which the display unit 10 is disposed, or may be provided as a separate chip.

In an exemplary embodiment, the data driver 30 is connected to the data lines DA1 to Dam, and generates a data signal based on an image data signal from an external image source and sequentially transfers the data signal to the pixels of the display unit 10 through the data lines DA1 to DAm.

The timing controller 40 generates a control signal to control an operation of the integral driver 20 and the data driver 30 using a horizontal synchronization signal Hsync, a vertical synchronization signal Vsync and a clock signal Mclk which are input thereto from the outside. In an exemplary embodiment, the data driving control signal DCS generated by the timing controller 40 is provided to the data driver 30, and the driving control signal SCS is provided to the integral driver 20.

In an exemplary embodiment, the timing controller 40 receives an external image source RGB and generates and transfers the image data signal including red data DR, green data DG and blue data DB through a predetermined image processing procedure to the data driver 30, and the data driver transfers a data voltage corresponding to respective image data signal including the red data DR, the green data DG and the blue data DB to each data line.

Figure 2:
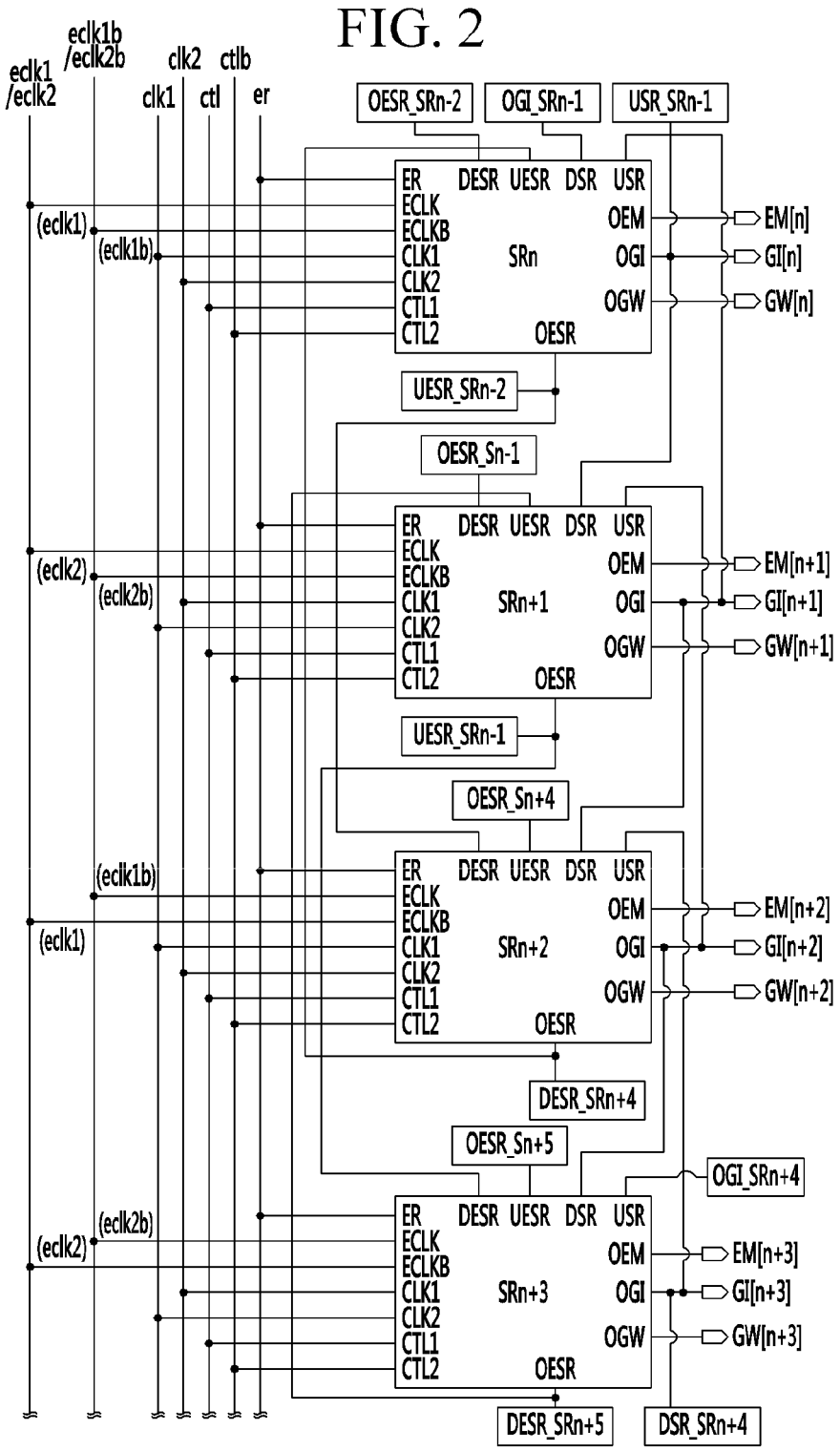
FIG. 2 is a block diagram schematically illustrating an exemplary embodiment of an integral driver shown in FIG. 1.

FIG. 2 is a block diagram illustrating an exemplary embodiment of the integral driver shown in FIG. 1. FIG. 2 shows an exemplary embodiment of a driving apparatus that may function as the integral driver 20 of FIG. 1.

The driving apparatus shown in FIG. 2 includes a plurality of shift registers connected to a plurality of output lines, e.g., the first gate lines to transfer the first gate signal, the second gate lines to transfer the second gate signal and the light emission control lines to transfer a light emission control signal. For convenience of illustration, FIG. 2 illustrates shift registers corresponding to four stages, that is, an n-th shift register SRn to an (n+3)-th shift register SRn+3 among the shift registers.

In an exemplary embodiment, as shown in FIG. 2, each of the plurality of shift registers includes 11 input terminals and 4 output terminals.

Although not shown in a block diagram of FIG. 2, each of the shift registers includes a first driver and a second driver. A detailed circuit arrangement of each shift register will be described later in greater detail with reference to FIG. 3.

In such an embodiment, the 11 input terminals of each of the shift registers include a first forward driving signal terminal DESR, a first backward driving signal terminal UESR, a second forward driving signal terminal DSR, a second backward driving signal terminal USR, a retain signal terminal ER, an input signal terminal ECLK, an inversion input signal terminal ECLKB, a first clock signal clock CLK1, a second clock signal terminal CLK2, a first control signal terminal CTL1, and a second control signal terminal CTL2.

In such an embodiment, the 4 output terminals include an intermediate output signal terminal OESR, a first output signal terminal OEM, a second output signal terminal OGl, and a third output signal terminal OGW.

In such an embodiment, the first forward driving signal terminal DESR of a register of a stage (also referred to as a "current stage") is connected to the intermediate output signal terminal OESR of a shift register at a second previous stage thereof. Accordingly, the first driver of the shift register at the second previous stage receives an intermediate output signal of the current stage as an input signal. In such an embodiment, the first forward driving signal terminals DESR of the shift registers of the first and second stages, which does not have previous stages, receive a dummy signal instead of the intermediate output signal. The first driver of a shift register of the current stage starts a forward drive in response to a signal input to the first forward driving signal terminal DESR thereof.

In such an embodiment, as shown in FIG. 2, the first forward driving signal terminal DESR of a shift register SRn at an n-th stage is connected to an intermediate output signal terminal OESR_SRn−2 of the shift register SRn−2 at an (n−2)-th stage, which is a second previous stage thereof, to receive an intermediate output signal esr[Sn−2] of the (n−2)-th stage.

The first backward driving signal terminal UESR of the shift register of the current stage is connected to an intermediate output signal terminal OESR of a shift register of a second next stage thereof. Accordingly, an intermediate output signal output from the first driver of a shift register at the second next stage is applied to the shift register of the current stage as an input signal. In such an embodiment, the first backward driving signal terminals UESR of the shift registers of the first and second stages, which does not have previous stages, receive a dummy signal instead of the intermediate output signal. The first driver of the shift register of the current stage starts a backward drive in response to a signal input to the first backward driving signal terminal UESR thereof.

In such an embodiment, as shown in FIG. 2, the first backward driving signal terminal UESR of a shift register SRn+3 at an (n+3)-th stage is connected to an intermediate output signal terminal OESR_SRn+5 of a shift register SRn+5 at an (n+5)-th stage, which is a second next stage of the (n+3) stage, to receive an intermediate output signal esr[Sn+5] of the shift register SRn+5 at the (n+5)-th stage.

The second forward direction driving signal terminal DSR of the register of the current stage is connected to the second output signal terminal OGl of a shift register at a first previous stage thereof. Accordingly, the second output signal (first gate signal) output from the second driver of the shift register at the first previous stage is applied to the shift register of the current stages as the input signal. In such an embodiment, the second forward driving signal terminal DSR of the shift registers of the first and second stages, which does not have previous stages, receive a dummy signal instead of the second output signal. The second driver of the shift register of the current stage starts a forward drive in response to a signal input to the second forward driving signal terminal DSR thereof.

In such an embodiment, as shown in FIG. 2, the second forward driving signal terminal DSR of the shift register SRn of the n-th stage is connected to the second output signal terminal OGl_SRn−1 of a shift register SRn−1 at an (n−1)-th stage, which is the first previous stage of the n-th stage, to receive the second output signal Gl[Sn−1] of the shift register SRn−1 at the (n−1)-th stage.

The second backward driving signal terminal USR of the register of the current stages is connected to the second output signal terminal OGl of a shift register at a first next stage thereof. Accordingly, the second output signal output from the second driver of the shift register at the first next stage is applied to the shift register at the current stage as an input signal. In such an embodiment, the second backward driving signal terminals USR of the shift registers of the first and second stages, which does not have previous stages, receive a dummy signal instead of the second output signal. The second driver of the shift register of the current stage starts a backward drive in response to a signal input to the second backward driving signal terminal USR thereof.

In such an embodiment, as shown in FIG. 2, the second backward driving signal terminal UESR of the shift register SRn+3 at an (n+3)-th stage is connected to a second output signal terminal OGl_SRn+4 of a shift register (SRn+4) at an (n+4)-th stage, which is a first next stage of the (n+3)-th stages, to receive a second output signal Gl[Sn+4] of the shift register SRn+4 at the (n+4)-th stage Connection relationships between the first forward driving signal terminal, the first backward driving signal terminal, the second forward driving signal terminal and the second backward driving signal terminal of other shift registers of the driving apparatus and input signals thereto are substantially the same as the shift registers shown in FIG. 2, and any repetitive detailed description thereof will be omitted.

In an exemplary embodiment, the shift register of the current stage receives a retain signal er through the retain signal terminal ER. In one exemplary embodiment, for example, a retain signal terminal may be provided at the first driver of the shift register at the current stage. According to an exemplary embodiment, the retain signal er is applied to the retain signal terminal ER of the shift register of the current stage as a bias voltage of a predetermined level upon initial drive of the first driver of the shift register to retain the potential at a predetermined node, such that the number of the signal terminals ER may be controlled or the signal terminal ER may be omitted according to a circuit design.

In an exemplary embodiment, four input signals including a first input signal eclk1 a second input signal eclk2, a first inversion input signal eclk1*b* and a second inversion input signal eclk2*b* are input to the input signal terminals ECLK of the first driver of the shift registers at four consecutive stages, respectively. In such an embodiment, as shown in FIG. 2, the first input signal eclk1 is input to the input signal terminal ECLK of the shift register SRn of the n-th stage, the second input signal eclk2 is input to the input signal terminal ECLK of the shift register SRn+1 at the (n+1)-th stage, the first inversion input signal eclk1*b* is input to the input signal terminal ECLK of the shift register SRn+2 at the (n+2)-th stage, and the second inversion input signal eclk2*b* is input to the input signal terminal ECLK of the shift register SRn+3 at the (n+3)-th stage. In such an embodiment, the four input signals eclk1, eclk2, eclk1*b* and eclk2*b* are transferred to the input signal terminals ECLK of four consecutive stages after an (n+3)-th shift register, respectively.

In an exemplary embodiment, four inversed input signals, which are obtained by inverting pulse signals of the four input signals transferred to the input signal terminals ECLK of the shift registers at the four consecutive stages, are transferred to the inversion input signal terminals ECLKB of the first drivers of the shift registers at the four consecutive stages, respectively. In such an embodiment, the first inversion input signal eclk1*b*, the second inversion input signal eclk2*b*, the first input signal eclk1 and the second inversion input signal eclk2 are transferred to the inversion input signal terminals ECLKB of the first drivers of the shift registers at the four consecutive stages, respectively.

In such an embodiment, as shown in FIG. 2, the first inversion input signal eclk1*b* is input to the inversion input signal terminal ECLKB of the shift register SRn at the n-th stage, the second inversion input signal eclk2*b* is input to the inversion input signal terminal ECLKB of the shift register SRn+1 of the (n+1)-th stage, the first input signal eclk1 is input to the inversion input signal terminal ECLKB of the shift register SRn+2 at the (n+2)-th stage, and the second input signal eclk2 is input to the input signal terminal ECLKB of the shift register SRn+3 at the (n+3)-th stage. In such an embodiment, the four inversed input signals, eclk1*b*, eclk2*b*, eclk1 and eclk2 obtained by inverting phases of the four input signals eclk1, eclk2, eclk1*b* and eclk2*b* applied to the input signal terminals ECLK of the shift registers of four consecutive stages after the (n+3)-th stages are transferred to the inversion input signal terminals ECLKB of the shift registers of the four consecutive stages after the (n+3)-th stages, respectively.

In an exemplary embodiment of a driving apparatus, the first clock signal or the second clock signal is transferred to the first clock signal terminal CLK1 and the second clock signal terminal CLK2 of each of the shift registers.

In such an embodiment, the first clock signal or the second clock signal is sequentially and alternately transferred to the first clock signal terminal CLK1 and the second clock signal terminal CLK2 of a second driver of a shift register at each stage.

In one exemplary embodiment, as shown in FIG. 2, when the first clock signal clk1 is transferred to the first clock signal terminal CLK1 of the second driver of the shift register SRn at the n-th stage, and the second clock signal clk2 is transferred to the second clock signal terminal CLK2 of the shift register SRn at the n-th stage, the second clock signal clk2 is transferred to the first clock signal terminal CLK1 of the second driver of the shift register SRn+1 of the (n+1)-th stage, which is the first next stage of the n-th stage, and the first clock signal clk1 is transferred to the second clock signal terminal CLK2 of the second driver of the shift register SRn+1 at the (n+1)-th stage.

In such an embodiment, as described, clock signals having different phase are input to the first clock signal terminal CLK1 and the second clock signal terminal CLK2, and the phase of the clock signals applied to the first clock signal terminal CLK1 or the second clock signal terminal CLK2 of the shift registers in two consecutive stages are different from each other.

In an exemplary embodiment, each of the first driver and the second driver of a shift register at a stage includes a first control signal terminal CTL1 and a second control signal terminal CTL2.

A first control signal ctl is input to the first control signal terminal, and a second control signal ctlb is input to the second control signal terminal. The first control signal ctl is a signal to control a forward drive of a driving apparatus including the shift registers, and the second control signal ctlb is a signal to control a backward drive of the driving apparatus.

In such an embodiment, when the first control signal ctl is input to the first control signal terminal CTL1 of the first driver and the second driver of each of the shift registers, the entire shift registers of the driving apparatus are driven in a forward direction such that a shift register of each stage sequentially outputs a plurality of output signals in a forward direction, e.g., from a first stage to a last stage.

In such an embodiment, when the second control signal ctlb is input to the second control signal terminal CTL2 of the first driver and the second driver of each of the shift registers, the entire shift registers of the driving apparatus are driven in a backward direction, such that a shift register at each stage sequentially outputs the output signals in a backward direction, e.g., from the last stage to the first stages.

In an exemplary embodiment, the intermediate output signal terminal OESR of each of the shift registers is included in the first driver thereof to output an intermediate output signal esr. The intermediate output signal terminal OESR of a shift register of the current stage is connected to the first backward driving signal terminal UESR and the first forward driving signal terminal DESR of a second next stage of the current stage. In such an embodiment, the intermediate output signal esr output from the intermediate output signal terminal OESR of a shift register of the current stage is transferred to the first forward driving signal terminal DESR of a second next state of the current state in a case of a forward drive, and is transferred to the first backward driving signal terminal UESR of a second previous stage of the current stage in a case of a backward drive.

In an exemplary embodiment, as shown in FIG. 2, the intermediate output signal esr output from the intermediate output signal terminal OESR of the first driver of the shift register SRn at the n-th stage is transferred to the first forward driving signal terminal DESR of the shift register SRn+2 at the (n+2)-th stage in a forward direction. Further, in a case of a backward drive, the intermediate output signal esr output from the intermediate output signal terminal OESR of the shift register SRn at the n-th stage is transferred to the first backward driving signal terminal UESR_SRn−2 of the a shift register at the (n−2)-th stage.

In such an embodiment, as in the shift register SRn at the n-th stage, the intermediate output signal esr output from the intermediate output signal terminal OESR of the shift register at another stage is transferred to the driving signal terminal of shift registers at the second next stage or the second previous stage thereof under the forward or backward drive, and any repetitive detailed description of a connection relationship of the intermediate output signal terminals OESR of the shift registers at other stages shown in FIG. 2 will be omitted.

In such an embodiment, the first output signal terminal OEM is included in a first driver of each of shift register as an output terminal, and outputs a first output signal. The first output signal may be a light emission control signal to control light emission in a display device.

In an exemplary embodiment, as shown in FIG. 2, the first output signal terminal OEM of the first driver of the shift register SRn at the n-th stage outputs a light emission control signal EM[n] of the n-th stage as the first output signal of the n-th stage. The output light emission control signal EM[n] of the n-th stage is transferred to the pixels in an n-th pixel row through an n-th light emission control line of the light emission control lines EM1 to EMl, where the n-th light emission control line is connected to the pixels in the n-th pixel row in the display unit. Here, n is a natural number equal to or less than l.

In such an embodiment, the second output signal terminal OGl is included in the second driver of each of the shift registers as an output terminal, and outputs a second output signal. The second output signal may be the first gate signal that transfers a data voltage written in a previous frame or controls to reset or initialize each pixel in the display device.

In an exemplary embodiment, as shown in FIG. 2, the second output signal terminal OGl of the second driver of the shift register SRn at the n-th stage outputs the first gate signal Gl[n] of the n-th stage as the second output signal of the n-th stage. The first gate signal Gl[n] of the n-th stage may be a signal transferred to the pixels in the n-th pixel row through an n-th first gate line of the first gate lines Gl1 to Gll in the display unit.

In an exemplary embodiment, the second output signal terminal OGl included in the second driver of a shift register at the current stage is connected to the second backward driving signal terminal USR of a shift register of a first previous stage of the current stage and the second forward driving signal terminal DSR of a shift register at a first next stage of the current stage. Accordingly, the second output signal output from the second output signal terminal OGl of the shift register at the current stage is transferred to the second forward driving signal terminal DSR of a shift register at the first next stage of the current stage in the forward drive, and is transferred to the second backward driving signal terminal USR of a shift register at a first previous stage of the current stage in the backward drive.

In an exemplary embodiment, as shown in FIG. 2, the second output signal Gl[n] output from the second output signal OGl of the second driver of the shift register SRn at the n-th stage is transferred to the second forward driving signal terminal DSR of the shift register SRn+1 at a the n (n+1)-th stage in a forward drive. In such an embodiment, in a case of the backward drive, the second output signal Gl[n] output from the second output signal terminal OGl of the shift register SRn at the n-th stage is transferred to the second backward driving signal terminal USR_SRn−1 of the shift register at the (n−1)-th stage.

In such an embodiment, as in the shift register SRn at the n-th stage, the second output signal output from the second output signal terminal OGl of a shift register at another stage is transferred to a driving signal terminal of a shift register at a first next stage or a first previous stage thereof under the forward or backward drive, and any repetitive detailed description of a connection relation between the second output signal terminals OGl of the shift registers at the other stages of FIG. 2 will be omitted.

In an exemplary embodiment, the third output signal terminal OGW is included in a second driver of each of the shift registers as an output terminal, and outputs a third output signal. The third output signal may be the second gate signal (or the scan signal) that activates the pixels to allow a data voltage corresponding to a data signal in each pixel to be written in a display device.

In an exemplary embodiment, as shown in FIG. 2, the third output signal terminal OGW of the second driver of the shift register SRn at the n-th stage outputs the second gate signal GW[n] at the n-th stage as the third output signal at the n-th stage. In such an embodiment, the second gate signal GW[n] at the n-th stage is transferred to each pixel in the n-th pixel row through the n-th second gate line of the second gate lines GW1 to GWn connected to the pixels in the n-th pixel row on the display unit.

In an exemplary embodiment, as described above, the driving apparatus may generate driving signals including the first output signal (e.g., the light emission control signal), the second output signal and the third output signal (e.g., the scan signal) through three output, and transfer the driving signals to the pixels in each pixel row, such that the driving signals to control operations of the display device such as a scan operation of the pixels and a light emitting operation, for example, are simultaneously generated from the driving apparatus in the display device.

In such an embodiment, a scan driver and a light emission control driver that generates a scan signal and a light emission control signal, respectively, to drive pixels, each including six transistors and one capacitor, are integrated into the driving apparatus (e.g., the integral driver in FIG. 1) such that a circuit area may be reduced by reducing a dead space in a layout design.

FIG. 2 shows a configuration of the shift registers of an exemplary embodiment of the driving apparatus, but the invention is not limited thereto.

In an alternative exemplary embodiment, the integral driver may be configured to generate the first output signal (e.g., the light emission control signal) and one of the second output signal and the third output signal.

Figure 3:
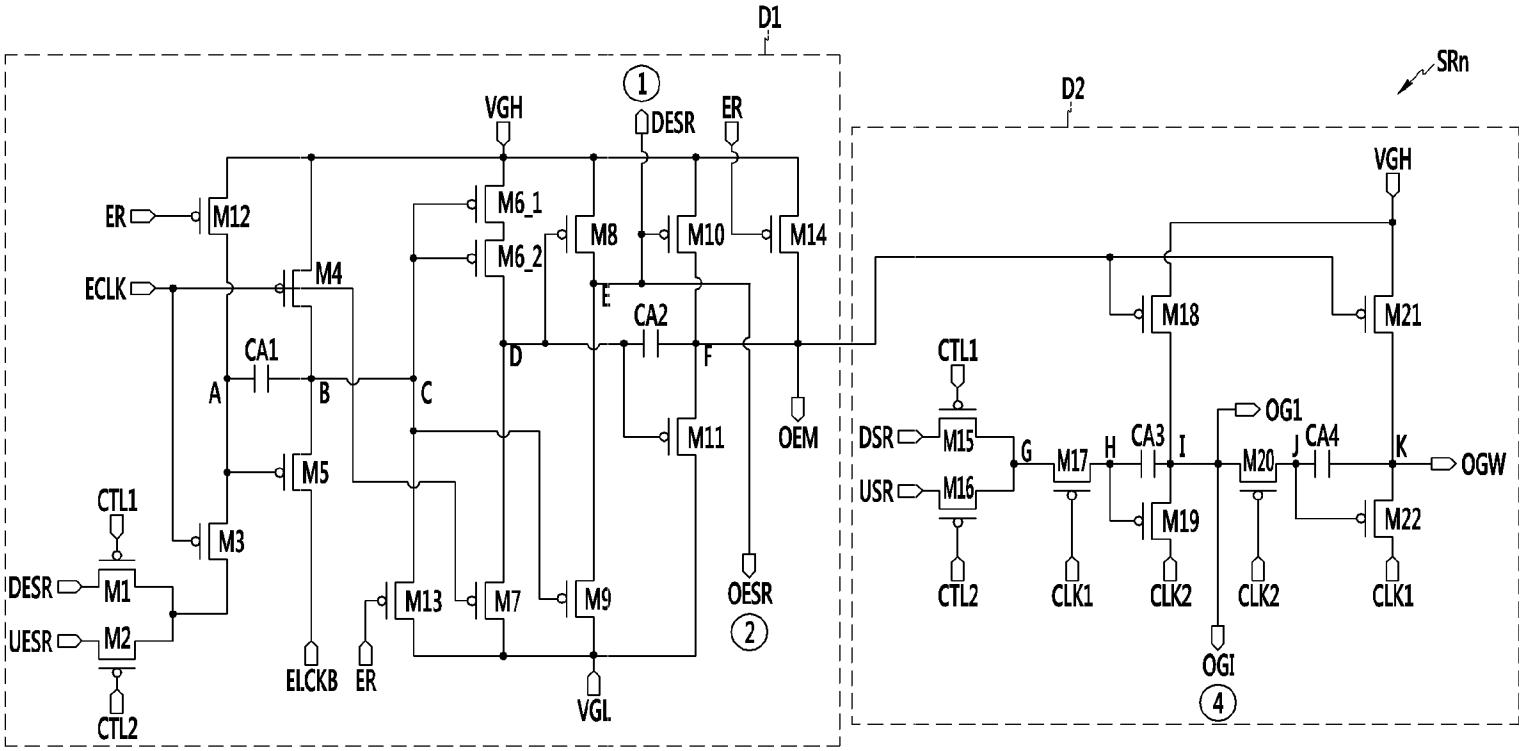
FIG. 3 is a circuit diagram illustrating an exemplary embodiment of a stage of the integral driver shown in FIG. 2.

FIG. 3 is a circuit diagram illustrating an exemplary embodiment of a stage of the integral driver shown in FIG. 2.

FIG. 3 illustrates a circuit diagram showing the shift register SRn at the n-th stage (hereinafter, n-th shift register SRn) in the integral driver of FIG. 2.

In an exemplary embodiment, as shown in FIG. 3, the n-th shift register SRn of the driving apparatus (e.g., the integral driver 20) includes the first driver D1 and the second driver D2. The circuit diagram of FIG. 3 shows the input terminals, to which signals are applied, and the output terminals of the n-th shift register SRn. Signals applied and output to and from an input terminal and an output terminal of the driving apparatus (integral driver) will be described later with reference to FIGS. 4 and 5.

In an exemplary embodiment, the first driver D1 of the n-th shift register SRn includes the first control signal terminal CTL1, to which the first control signal is input in the forward drive, the second control signal terminal CTL2, to which the second control signal is input in the backward drive, an input signal terminal ECLK and an inversion input signal terminal ECLKB, to which a selected input signal corresponding to the n-th stage among the four input signals eclk1, eclk2, eclk1*b* and eclk2*b*, and an input signal inverted from the selected inverted input signal are transferred, and a retain signal terminal ER, to which a retain signal er is input. In such an embodiment, the first driver D1 is connected to a first power source voltage VGH having a predetermined high voltage level and a second power source voltage VGL having a voltage level lower than the first power source voltage VGH.

In such an embodiment, the first driver D1 includes the intermediate output signal terminal OESR connected to the shift register ① at the (n−2)-th stage, which is a second previous stage of the n-th stage, and the shift register ② of the (n+2)-th stage, which is a second next stage of the n-th stage. In such an embodiment, the first driver D1 includes the first output signal terminal OEM to output the first output signal (for example, the light emission control signal) of the n-th stage.

In an exemplary embodiment, as shown in FIG. 3, the first driver D1 may include 14 transistors, e.g., first to fourteenth transistors M1 to M14, and two capacitors, e.g., first and second capacitors CA1 and CA2, for example, but a configuration thereof is not limited thereto.

Referring to FIG. 3, the first transistor M1 of the first driver D1 of the n-th shift register SRn includes a gate electrode connected to the first control signal terminal CTL1, a source electrode connected to the first forward driving signal terminal DESR, and a drain electrode connected to a source electrode of the third transistor M3.

The second transistor M2 includes a gate electrode connected to the second control signal terminal CTL2, a source electrode connected to the first backward driving signal terminal UESR, and a drain electrode connected to the source elected of the third transistor M3 together with the drain electrode of the first transistor M1.

The third transistor M3 includes a gate electrode connected to the input signal terminal ECLK, a source electrode commonly connected to the drain electrodes of the first and second transistors M1 and M2, and a drain electrode connected to a first node A. The node connected to the first, second and third transistor M1, M2 and M3 may be defined as a first common node.

The fourth transistor M4 includes a gate electrode connected to the input signal terminal ECLK, a source electrode connected to the first power source voltage VGH to transfer a voltage having the predetermined high voltage level, and a drain electrode connected to a second node B.

The fifth transistor M5 includes a gate electrode connected to the first node A, a source electrode connected to the inversion input signal terminal ECLKB, and a drain electrode connected to the second node B.

In an exemplary embodiment, as shown in FIG. 3, the sixth transistor includes two sub-transistors, e.g., a first sub-transistor M6_1 and a second sub-transistor M6_2. The first sub-transistor M6_1 includes a gate electrode connected to a third node C, a source electrode connected to the first power source voltage VGH, and a drain electrode connected to the second sub-transistor M6_2. In such an embodiment, the second sub-transistor M6_2 includes a gate electrode connected to the third node C, a source electrode connected to the drain electrode of the first sub-transistor M6_1, and a drain electrode connected to a fourth node D. In an alternative exemplary embodiment, the transistor may be configured by a single transistor.

The seventh transistor M7 includes a gate electrode connected to the input signal terminal ECLK, a source electrode connected to the second power source voltage VGL to transfer a power source voltage lower than the first power source voltage VGH, and a drain electrode connected to a fourth node D.

The eighth transistor M8 includes a gate electrode connected to the fourth node D, a source electrode connected to the first power source voltage VGH, and a drain electrode connected to a fifth node E.

A transistor M9 includes a gate electrode connected to the third node C, a source electrode connected to the second power source voltage VGL, and a drain electrode connected to the fifth node E.

The output terminal OESR is connected to the fifth node E. A voltage (e.g., a pulse voltage of the intermediate output signal) of the fifth node E is transferred to the shift register ① at the (n−2)-th stage, which is the second previous stage of the n-th stage, and the shift register ② at the (n+2)-th stage, which is the second next stage, through the output terminal OESR.

A tenth transistor M10 includes a gate electrode connected to the fifth node E, a source electrode connected to the first power source voltage VGH, and a drain electrode connected to a sixth node F.

A eleventh transistor M11 includes a gate electrode connected to the fourth node D, a source electrode connected to the second power source voltage VGL, and a drain electrode connected to the sixth node F.

In an exemplary embodiment, the first output signal terminal OEM is connected to the sixth node F, and a voltage of the sixth node F is generated and transferred as a pulse voltage of the first output signal of the n-th stage. In such an embodiment, the voltage of the sixth node F is transferred to the second driver D2. Accordingly, an exemplary embodiment of the driving apparatus may output a pulse voltage at a high level of the third output signal from the second driver D2 based on a pulse voltage at a high level of the first output signal output from the first output signal terminal OEM of the first driver D1. Accordingly, in such an embodiment, a high level output of a scan signal may correspond to an output of a light emission control signal transferred to each pixel in the display device.

In an exemplary embodiment, as shown in FIG. 3, a twelfth transistor M12 includes a gate electrode connected to the retain signal terminal ER, a source electrode connected to the first power source voltage VGH, and a drain electrode connected to the first node A.

The thirteenth transistor M13 includes gate electrode connected to the retain signal terminal ER, a source electrode connected to the second power source voltage VGL, and a drain electrode connected to the third node C.

The fourteenth transistor M14 includes a gate electrode connected to the retain signal terminal ER, a source electrode connected to the first power source voltage VGH, and a drain electrode connected to the sixth node F.

When the twelfth to fourteenth transistors M12 to M14 are turned-on based on the retain signal transferred through the retain signal terminal ER, to which the gate electrode is connected, potentials of the first, third and sixth nodes A, C and F, to which the drain electrodes of the twelfth to fourteenth transistors M12 to M14 are connected, respectively, are maintained as a voltage applied through a power source voltage, to which the source electrodes of the twelfth to fourteenth transistors M12 to M1 are connected, respectively. In such an embodiment, the potentials at the first and sixth nodes A and F may be maintained as the first power source voltage having the high voltage level by the twelfth and fourteenth transistors M12 and M14, and the potential of the third node C may be maintained as the second power source voltage lower than the first power source voltage by the thirteenth transistor M13.

In an exemplary embodiment, the first driver D1 includes the first capacitor CA1 connected between the first and second nodes A and B. In such an embodiment, the first driver D1 includes the second capacitor CA2 connected between the fourth and sixth nodes D and F.

In an exemplary embodiment, the second driver D2 may include 8 transistors, e.g., fifteenth to twenty-second transistors M15 to M22, and two capacitors, e.g., a third capacitor CA3 and a fourth capacitor CA4, for example, but a configuration thereof is not limited thereto.

Referring to FIG. 3, in the second driver D2 of the n-th shift register SRn, the fifteenth transistor M15 includes a gate electrode connected to the first control signal terminal CTL1, a source electrode connected to the second forward driving signal terminal DSR, and a drain electrode connected to a source electrode of the seventeenth transistor M17.

The sixteenth transistor M16 includes a gate electrode connected to the second control signal terminal CTL2, a source electrode connected to the second backward driving signal terminal USR, and a drain electrode connected to the source electrode of the transistor M17 together with the drain electrode of the transistor M15.

The seventeenth transistor M17 includes a gate electrode connected to the first clock signal terminal CLK1, the source electrode connected a seventh node G (i.e., the second common node), to which the drain electrodes of the fifteenth and sixteenth transistors M15 and M16 are commonly connected, and a drain electrode connected to an eighth node H. The node connected to the fifteenth, sixteenth and seventeenth transistors M15, M16 and M17 may be defined as a second common node.

The eighteenth transistor M18 includes a gate electrode connected to the first output signal terminal OEM, to which the first output signal is output from the first driver D1, that is, the sixth node F, a source electrode connected to the first power source voltage VGH to transfer a voltage having the predetermined high voltage level, and a drain electrode connected to a ninth node I.

The nineteenth transistor M19 includes a gate electrode connected to the eighth node H, a source electrode connected to the second clock signal terminal CLK2, and a drain electrode connected to the ninth node I.

In an exemplary embodiment, the second output signal terminal OGl is connected to the ninth node I, such that a voltage at the ninth node I is output as a pulse voltage of the second output signal. In such an embodiment, the voltage at the ninth node I is transferred to the shift register ③ at the (n−1)-th stage, which is a first previous stage of the n-th stage, and the shift register ④ at the (n+1)-th stage, which is a first next stage of the n-th stage.

The twentieth transistor M20 includes a gate electrode connected to the second clock signal terminal CLK2, a source electrode connected to the ninth node I, and a drain electrode connected to a tenth node J.

The twenty-first transistor M21 includes a gate electrode connected to the first output signal terminal OEM, to which the first output signal is output from the first driver D1, the sixth node F, a source electrode connected to the first power source voltage VGH, and a drain electrode connected to an eleventh node K.

The twenty-second transistor M22 includes a gate electrode connected to the tenth node J, a source electrode connected to the first clock signal terminal CLK1, and a drain electrode connected to the eleventh node K.

The third output signal terminal OGW is connected to the eleventh node K, and a voltage at the eleventh node K is output as a pulse voltage of the third output signal (e.g., the second gate signal).

The second driver D2 includes a third capacitor CA3 connected between the eighth and ninth nodes H and I, and a fourth capacitor CA4 connected between the tenth and eleventh nodes J and K.

In an exemplary embodiment of the driving apparatus, as shown in FIG. 3, each shift register generates the first output signal in the first driver D1, and generates the second output signal and the third output signal in the second driver D2, but the invention is not limited thereto. In an alternative exemplary embodiment, the second driver D2 may generate one of the second output signal and the third output signal.

A procedure of generating the first output signal, the second output signal and the third output signal by operating the exemplary embodiment of the driving apparatus shown in FIG. 3 will be described with reference to circuit diagrams of FIGS. 4 and 5, and a signal timing diagram of FIG. 6.

Figure 4:
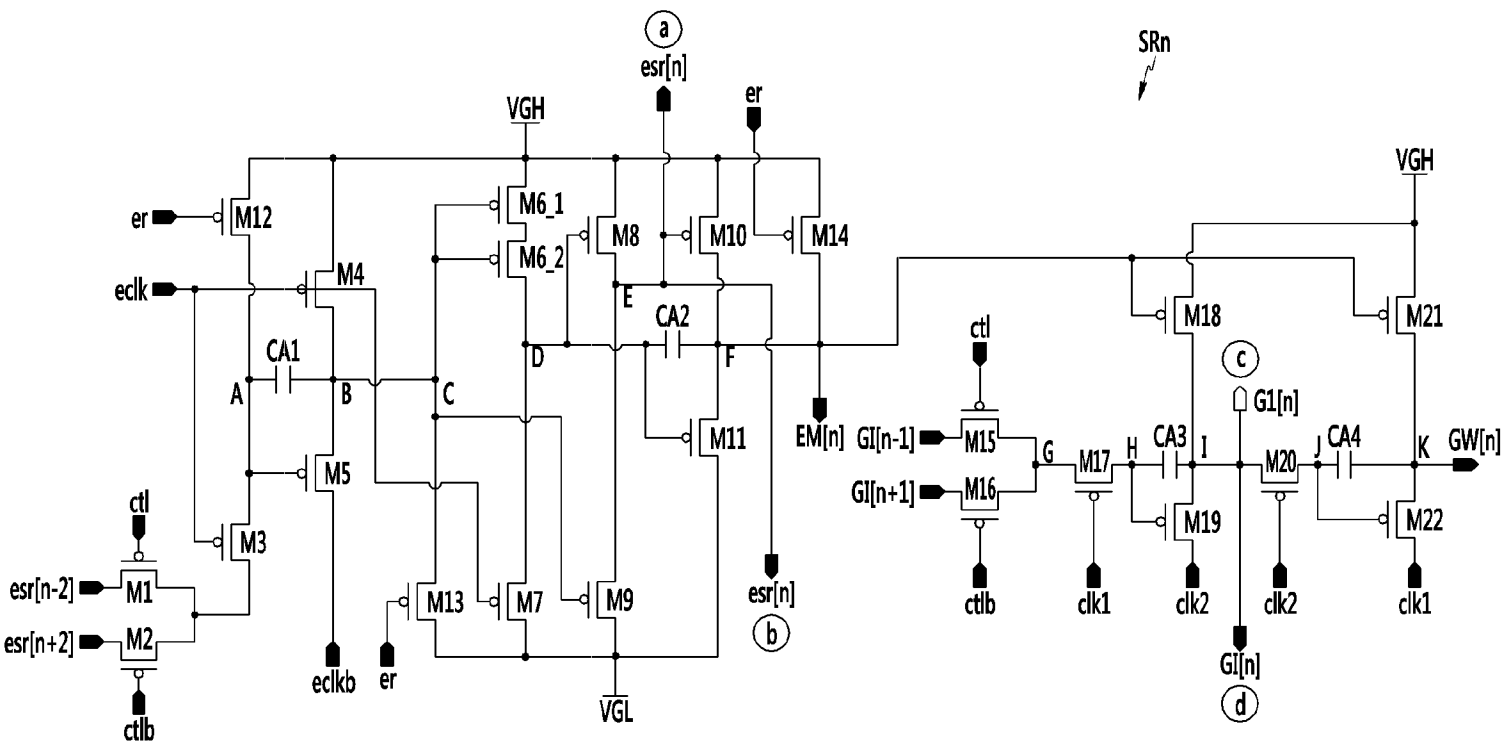
FIGS. 4 and 5 are circuit diagrams illustrating input and output signals with respect to two stages of the integral driver shown in FIG. 2.
Figure 5:
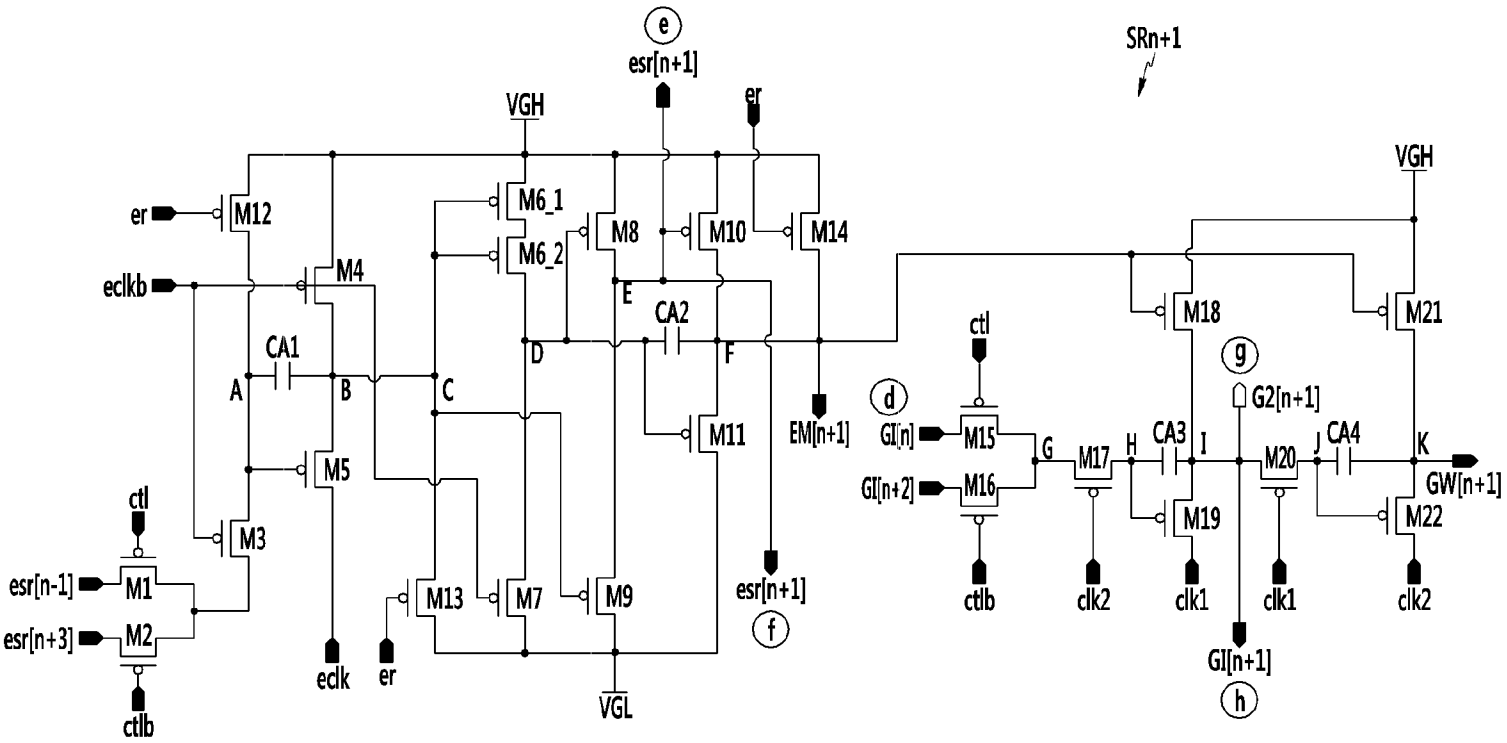
Figure 6:
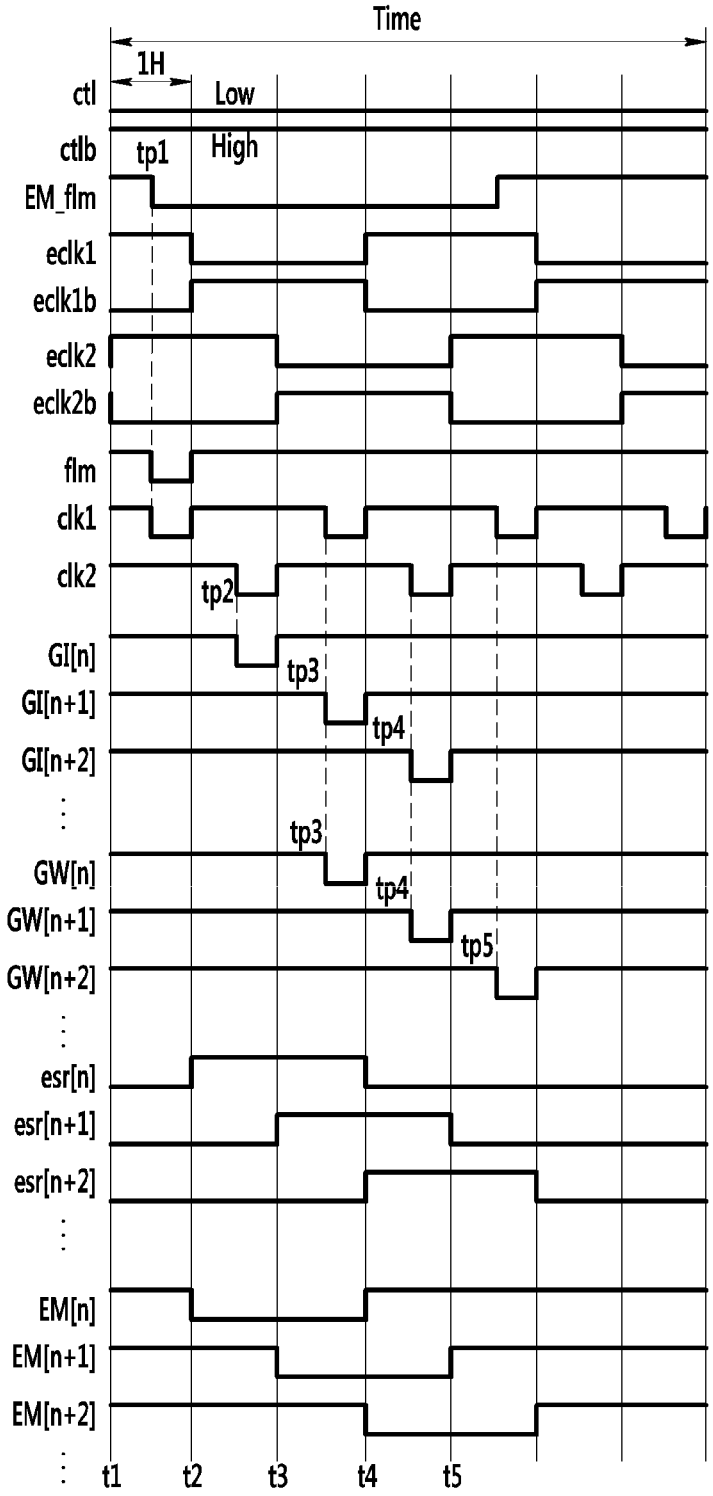
FIG. 6 is a signal timing diagram illustrating an operation of the integral driver shown in FIGS. 3 to 5.

FIGS. 4 and 5 are circuit diagrams illustrating input and output signals with respect to two stages of the integral driver shown in FIG. 2, and FIG. 6 is a signal timing diagram illustrating an operation of the integral driver shown in FIGS. 3 to 5.

FIG. 4 illustrates a circuit diagram of the n-th shift register SRn shown in FIG. 3 in the driving apparatus and signals which are applied and output to and from terminals thereof, FIG. 5 illustrates a circuit diagram of an (n+1)-th shift register SRn+1 at the first next stage of the n-th stage, and signals applied to respective terminals, and FIG. 6 illustrates signals applied to the input terminals or output from the output terminals of the n-th shift register SRn and the (n+1)-th shift register SRn+1.

In such an embodiment, a connection relationship between shift registers in the driving apparatus is substantially the same as in the exemplary embodiment illustrated in FIG. 2.

In such an embodiment, a timing diagram of FIG. 6 shows input and output signals under the forward drive. A procedure of generating output signals under the forward drive will be described with reference to the circuit diagrams of FIGS. 4 and 5, for convenience of description.

Since the shift registers of FIGS. 4 and 5 have substantially the same circuit arrangement, and signals transferred to an input signal terminal and the clock signal terminal of the shift registers of FIGS. 4 and 5 are different from each other, a driving procedure of the shift registers will be described with reference mainly to FIG. 4.

In an exemplary embodiment, when the shift registers are driven in the forward drive as shown in FIG. 6, the first control signal ctl has a low level voltage. In such an embodiment, as shown in FIG. 4, the first control signal ctl at the low level is applied through the first control signal terminal of the first driver and the second driver of a shift register, e.g., the n-th shift register. Accordingly, the first and fifteenth transistors M1 and M15 are turned-on by the first control signal ctl applied to each of the gate electrodes of the first and fifteenth transistors M1 and M15.

In such an embodiment, the second control signal ctlb controls a backward drive. In such an embodiment, the second control signal ctlb is an inverted signal of the first control signal ctl, such that the second control signal ctlb is applied with a voltage at a high level. Accordingly, when the forward drive is performed, the gate electrodes of the second and sixteenth transistors M2 and M16 receive the second control signal ctlb at the low level such that the second and sixteenth transistors M2 and M16 maintain a turn-off state.

When the first and fifteenth transistors M1 and M15 are turned-on, an intermediate output signal esr[n−2] of the (n−2)-th stage, which is the second previous stage of the n-th stage, is applied to a source electrode of the first transistor M1, and the second output signal (e.g., the first gate signal) Gl[n−1] of the (n−1)-th stage, which is the first previous stage of the n-th stage is applied to the source electrode of the fifteenth transistor M15.

The intermediate output signal esr[n−2] of the (n−2)-th stage is shown as a start signal EM_flm of the first driver in FIG. 6, and may have a low level at a first time point tp1 between a first time t1 and the second time t2 as the start signal EM_flm of the first driver.

In an exemplary embodiment, the second output signal (e.g., the first gate signal) Gl[n−1] of the (n−1)-th stage is shown as a start signal flm of the second driver in FIG. 6, and may have a low level at the first time point tp1 as the start signal flm of the second driver.

FIG. 6 illustrates a signal timing diagram of the start signal EM_flm applied to the first driver of a shift register at a first stage and a start signal flm applied to the second driver of the shift register of the first stage. In an exemplary embodiment, when a current stage has the first and second previous stages, the intermediate output signal esr of the second previous stage of the current stage is applied to the first forward driving signal terminal of the shift register of the current stage as the start signal Em_flm of the first driver, and the second output signal Gl of the first previous stage of the current stage is applied to the second forward driving signal of the shift register at the current stage as the start signal flm of the second driver.

When the intermediate output signal esr[n−2] of the (n−2)-th stage at a low level is applied to the first transistor M1 of the n-th shift register SRn at the first time point tp1, the third transistor M3 is turned-on by the first input signal eclk1 in a low level at the second time t2, and a low level voltage is thereby applied to the first node A. The fifth transistor M5 is turned-on by the low level voltage applied to the first node A, and the fourth and seventh transistors M4 and M7 are turned-on by the first input signal eclk1.

The pulse voltage at a high level of the first inversion input signal eclk1*b* applied to the source electrode of the fifth transistor M5, which is turned-on by the low level voltage from the first node A, is provided to the second node B, and the first power source voltage VGH at a predetermined high level applied to the source electrode of the fourth transistor M4, which is turned-on by the first input signal eclk1, is provided to the second node B. Accordingly, in such an embodiment, where both electrodes of the first capacitor CA1 are connected between the first node A and the second node B, respectively, a difference between a low level voltage of the intermediate output signal esr[n−2] of the (n−2)-th stage applied to the both electrodes and a high level voltage of the first inversion input signal eclk1*b* is maintained.

In such an embodiment, the second power source voltage VGL at a predetermined low level applied to a source electrode by the seventh transistor M7, which is turned-on by the first input signal eclk1, is provided to the fourth node D. The eight transistor M8 and the eleventh transistor M11 are turned-on by a low level voltage at the fourth node D.

The first power source voltage VGH at the high level applied to the source electrode of the eighth transistor M8, which is turned-on by the low level voltage at the fourth node D, is provided to the fifth node E. In such an embodiment, the tenth transistor M10 is turned-off by the high level voltage applied to the fifth node E, and an n-th intermediate output signal esr[n], that is, the intermediate output signal from the n-th shift register SRn, is output from the first driver of the shift register at the n-th stage through the intermediated output signal terminal connected to the fifth node E. In an exemplary embodiment, as shown in FIG. 6, a high level voltage applied to the fifth node E at the second time t2 may be output as the n-th intermediate output signal esr[n], and the intermediate output signal esr[n] of the n-th shift register SRn may be output in synchronization with the second time t2, but not being limited thereto. In an alternative exemplary embodiment, the n-th intermediate output signal esr[n] may be output before or after the second time t2.

The n-th intermediate output signal esr[n] is transferred to the first forward driving signal terminal of the shift register at the (n+2)-th stage, which is the second next stage ⓑ, in the forward drive. The n-th intermediate output signal esr[n] is transferred to the first backward driving signal terminal of the shift register at the (n−2)-th stage, which is the second previous stage ⓐ, in the backward drive.

In an exemplary embodiment, the second power source voltage VGL at the low level applied to the source electrode of the eleventh transistor M11, which is the turned-on by the low level voltage at the fourth node D, is provided to the sixth node F. In such an embodiment, n-th the first output signal (light emission control signal) EM[n] is output from the first driver of the shift register at the n-th stage (the current stage) through the first output signal terminal connected to the sixth node F. Referring to FIG. 6, although the n-th the first output signal (e.g., the light emission control signal) EM[n] may be output with a low level voltage applied to the sixth node F at the second time t2, the n-th the first output signal may not be in synchronization with the second time t2. In such an embodiment, a low level voltage applied to the sixth node F is provided to the second driver of the n-th shift register SRn.

In an exemplary embodiment, the low level voltage applied to the sixth node F is transferred to the eighteenth transistor M18 and the twenty-first transistor M21 of the second driver such that the eighteenth transistor M18 and the twenty-first transistor M21 are turned on.

Accordingly, the first power source voltage VGH at the high level is applied to the ninth node I by the eighteenth transistor M18, which is turned-on by the low level voltage of the sixth node F, and the first power source voltage VGH at the high level is applied to the eleventh node K by the twenty-first transistor M21, which is turned-on by the low level voltage of the sixth node F. Accordingly, an n-th second output signal Gl[n] output from the second output signal terminal of the second driver connected to the ninth node I and an n-th third output signal GW[n] output from the third output signal terminal of the second driver connected to the eleventh node K have a high level voltage at the second time t2.

In such an embodiment, when the n-th first output signal (e.g., light emission control signal) EM[n] is output as a pulse voltage at a low level (e.g., during a time period between the second time t2 to a fourth time t4), the n-th second output signal Gl[n] and the n-th third output signal GW[n] may be maintained at an output voltage at a high level until the n-th second output signal Gl[n] and the n-th third output signal GW[n] are output as a low level pulse voltage.

In an exemplary embodiment, the n-th second output signal (e.g., the first gate signal) Gl[n−1] of the (n−1)-th stage is applied as the start signal flm of the second driver shown in FIG. 6, and the second output signal Gl[n−1] of the (n−1)-th stage at a low level is transferred to the seventh node G at the first time point tp1. The first clock signal clk1 is transferred to the seventeenth transistor M17 at the first time point tp1 as a pulse voltage at a low level, and the seventeenth transistor M17 is thereby turned-on such that a low level voltage at the seventh node G is provided to the eighth node H.

The low level voltage transferred to the eighth node H is provided to the gate electrode of the nineteenth transistor M19 such that the nineteenth transistor M19 is turned-on. The turned-on nineteenth transistor M19 receives a pulse voltage of the second clock signal clk2 through the source electrode thereof, and transfers the pulse voltage of the second clock signal clk2 to the ninth node I. The third capacitor CA3 connected between the eighth node H and the ninth node I stores and retains a potential difference between electrodes thereof, which are connected to the eighth node H and the ninth node I, respectively.

Then, at a second time point tp2 between the second time t2 and a third time t3, the second clock signal clk2 has a pulse voltage at a low level, and a voltage at the ninth node I is changed to a low level through the nineteenth transistor M19 based on the lowered pulse voltage of the second clock signal clk2. Accordingly, the n-th second output signal (e.g., the first gate signal) Gl[n] is generated, and n-th second output signal Gl[n] in a low level is output from the second output signal terminal of the second driver of the n-th stage connected to the ninth node I at the second time point tp2.

In an exemplary embodiment, the n-th the second output signal (e.g., the first gate signal) Gl[n] is transferred to the second forward driving signal terminal of the (n+1)-th stage, which is the first next stage ⓓ, in a forward drive. In such an embodiment, the n-th the second output signal (e.g., the first gate signal) Gl[n] is transferred to the second backward driving signal terminal of an (n−1)-th stage, which is the first previous stage ⓒ, in the backward drive.

In an exemplary embodiment, when the second clock signal clk2 is changed to a low level at the second time point tp2, the twentieth transistor M20 that receives the second clock signal clk2 at a low level is turned-on, and a low level voltage at the ninth node I is transferred to the tenth node J.

Accordingly, the twenty-second transistor M22 is turned-on by the low level voltage at the tenth node J. The turned-on twenty-second transistor M22 receives a pulse voltage of the first clock signal clk1 through the source electrode thereof, and transfers the pulse voltage of the first clock signal clk1 to the eleventh node K. The fourth capacitor CA4 connected between the tenth node J and the eleventh node K stores and retains a potential difference between electrodes thereof, which are connected to the tenth node J and the eleventh node K, respectively.

In an exemplary embodiment, the first clock signal clk1 and the second clock signal clk2 have a phase difference of one horizontal period 1H, and the first clock signal clk1 is applied as a pulse voltage having a high level at the second time point tp2, and decreases to a pulse voltage having a low level at a third time point tp3 between the third time t3 and the fourth time t4. Accordingly, a voltage at the eleventh node K is changed based on the pulse voltage of the first clock signal clk1.

In an exemplary embodiment, the n-th third output signal (e.g., the second gate signal) GW[n] is generated and output from the third output signal terminal of the second driver of the n-th stage connected to the eleventh node K at the third time point tp3.

When the first input signal eclk1 increases to a high level at the fourth time t4, and the first inversion input signal eclk1*b* decreases to a low level, the third, fourth and seventh transistors M3, M4 and M7 are all turned-off. When a low level voltage is applied to the second node B based on the first inversion input signal eclk1*b*, the first and second sub-transistors M6_1 and M6_2 of the sixth transistor, and the ninth transistor M9 are turned-on.

The fourth node D receives the first power source voltage VGH at a high level through the turned-on first and second sub-transistors M6_1 and M6_2, and the eighth transistor M8 and the eleventh transistor M11 are thereby turned-off.

The second power source voltage VGL at a low level applied to the source electrode of the turned-on ninth transistor M9 is transferred to the fifth node E. Accordingly, the tenth transistor M10 is turned-on by the low level voltage transferred to the fifth node E, and the n-th intermediate output signal esr[n] decreases to a low level and is output from the first driver of the shift register at the n-th stage (the current stage) through the intermediate output signal terminal connected to the fifth node E. Referring to FIG. 6, the n-th intermediate output signal esr[n] may be output as a low level voltage applied to the fifth node E at the fourth time t4, but may not be in synchronization with the fourth time t4, e.g., the n-th intermediate output signal esr[n] may be output before or after the fourth time t4.

In an exemplary embodiment, the first power source voltage VGH at a high level applied to a source electrode of the turned-on tenth transistor M10 is transferred to the sixth node F. Accordingly, the n-th the first output signal (e.g., the light emission control signal) EM[n] increased to a high level and is output through the first output signal terminal connected to the sixth node F. Referring to FIG. 6, the n-th the first output signal (e.g., the light emission control signal) EM[n] may be output as the high level voltage applied to the sixth node F at the fourth time t4, but may not be in synchronization with timing t4. In such an embodiment, the high level voltage applied to the sixth node F is transferred to the second driver of the n-th shift register SRn.

Referring to FIG. 4 and FIG. 6, a pulse voltage in the intermediate output signal esr[n] and the n-th first output signal EM[n] varies corresponding to variation in a pulse voltage at the second time t2 and the fourth time t4 of the first input signal eclk1 applied to the input signal terminal. In such an embodiment, during a time interval between the second time t2 and the fourth time t4, then n-th first output signal EM[n] at a low level is output as a pulse of the first input signal eclk1.

In such an embodiment, the n-th second output signal Gl[n] and the n-th third output signal GW[n] output from the second driver of the n-th shift register SRn are output with a pulse voltage corresponding to voltage levels at the ninth node I and the eleventh node K, to which the second output signal terminal and the third output signal terminal are connected. Accordingly, the n-th the second output signal Gl[n] is output with a pulse voltage at a low level based on the second clock signal clk2 applied to the source electrode of the nineteenth transistor M19 connected to the ninth node I at the second time point tp2. In such an embodiment, the n-th the third output signal GW[n] is output with a pulse voltage at a low level based on the first clock signal clk1 applied to the source electrode of the twenty-second transistor M22 connected to the eleventh node K at the third time point tp3.

In an exemplary embodiment, although not shown in FIG. 6, the retain signal er applied to the retain signal terminal of the n-th shift register SRn retains a gate electrode voltage of a transistor to which the retain signal er is transferred as a bias voltage at an initial drive of the driving apparatus.

Accordingly, in the initial drive of the driving apparatus, the retain signal er may be transferred to the twelfth, thirteenth and fourteenth transistors M12, M13 and M14 with a low level voltage, respectively. As a result, the twelfth transistor M12 is turned-on such that the voltage at the first node A may be maintained by the first power source voltage VGH at a high level.

When the thirteenth transistor M13 is turned-on by the retain signal er, the second power source voltage VGL at a low level is transferred to the third node C, and the ninth transistor M9 is thereby turned-on, and the second power source voltage VGL at a low level is again applied to the fifth node E such that the tenth transistor M10 is turned-on. Accordingly, the sixth node F is maintained at the first power source voltage VGH of a high level transferred through the turned on transistor M10. In such an embodiment, the fourteenth transistor M14 is turned-on by the retain signal er such that the first power source voltage VGH is transferred to the sixth node F. Accordingly, the voltage at the sixth node F is maintained at a bias voltage at a high level in the initial drive.

FIG. 5 is a circuit diagram illustrating the (n+1)-th shift register SRn+1, which is the first next stage of the n-th shift register shown in FIG. 4.

As shown in FIG. 6, output signals at the (n+1)-th stage are generated by the (n+1)-th shift register SRn+1 shown in FIG. 5.

A driving procedure of the (n+1)-th shift register SRn+1 in FIG. 5 is substantially similar to the driving procedure of the n-th shift register SRn described above with reference to FIGS. 4 and 6, and any repetitive detailed description thereof will hereinafter be omitted.

In the (n+1)-th shift register SRn+1 shown in FIG. 5, the second input signal eclk2 is applied to the input signal terminal thereof, and the second inversion input signal eclk2*b* is applied to the inversion input signal terminal thereof.

In the (n+1)-th shift register SRn+1, which is in the forward drive, the first transistor M1 is turned-on by the first control signal ctl, and the second transistor M2 is turned-off by the second control signal ctlb, which is an inverted signal of the first control signal ctl.

In an exemplary embodiment, a pulse voltage level of an (n+1)-th intermediate output signal esr[n+1] output from the (n+1)-th shift register SRn+1 varies based on variation in a pulse voltage of the second input signal eclk2 in the forward drive procedure at the third time t3 and a fifth time t5. In such an embodiment, the (n+1)-th intermediate output signal esr [n+1] increases to a high level pulse voltage at the third time t3 as a pulse voltage of the second input signal eclk2 decreases. In such an embodiment, as a pulse voltage of the second input signal eclk2 ascends at the fifth time t5 increases, the (n+1)-th intermediate output signal esr[n+1] decreases to a low level pulse voltage.

In such an embodiment, the (n+1)-th intermediate output signal esr[n+1] is transferred to the first forward driving signal terminal at the (n+3)-th stage, which is the second next state ⓕ of the (n+1)-th stage, in the forward drive. In such an embodiment, when the driving apparatus is driven in the backward drive, the (n+1)-th intermediate output signal esr [n+1] is transferred to the first backward driving signal terminal of the (n−1)-th stage, which the second previous stage ⓔ of the (n+1)-th stage.

In an exemplary embodiment, a pulse voltage level of the first output signal EM[n+1] output from the (n+1)-th shift register SRn+1 is changed corresponding to variation in a pulse voltage of the second input signal eclk2 at the third time t3 and the fifth time t5 during the forward drive. In such an embodiment, the first output signal EM[n+1] at the (n+1)-th stage decreases to a low level pulse voltage as the pulse voltage of the second input signal eclk2 decreases to the low level pulse voltage at the third time t3. In such an embodiment, as the pulse voltage of the second input signal eclk2 increases at the fifth time t5, the first output signal EM[n+1] increases to a high level pulse voltage.

In the (n+1)-th shift register SRn+1 shown in FIG. 5, the second clock signal clk2 is applied to the first clock signal terminal, and the first clock signal clk1 is applied to the second clock signal terminal.

When the (n+1)-th shift register SRn+1 is driven in the forward drive, the fifteenth transistor M15 is turned-on by the first control signal ctl, and the sixth transistor M6 is turned-off by the second control signal ctlb, which is the inverted signal of the first control signal ctl.

The n-th second output signal Gl[n] transferred from the second output signal terminal of the second driver of the n-th shift register SRn at an n-th stage at the second time point tp2 is transferred with a low level voltage.

When the second clock signal clk2 applied to the first clock signal terminal is at a low level, the second clock signal clk2 is transmitted through the transistor M17 such that a low level voltage is transferred to the eighth node H, thereby turning-on the ninth transistor M19. The (n+1)-th second output signal Gl[n+1] output from the second driver of the (n+1)-th shift register (SRn+1) has a pulse voltage corresponding to a voltage level of the ninth node I, to which the second output signal terminal is connected. Accordingly, the (n+1)-th second output signal Gl[n+1] is output as a pulse voltage at a low level at the third time point tp3 based on the first clock signal clk1 applied to a source electrode of the nineteenth transistor M19 connected to the ninth node I.

The (n+1)-th second output signal (e.g., the first gate signal) Gl[n+1] is transferred to the second forward driving signal terminal of an (n+2)-th, which is a first next stage ⓗ, in the forward drive. In a backward drive, the (n+1)-th second output signal (e.g., first gate signal) Gl[n+1] is transferred to the second backward driving signal terminal of the n-th stage, which is a first previous stage ⓖ.

In the meantime, an (n+1)-th third output signal GW[n+1] output from the second driver of the (n+1)-th shift register SRn+1 has a pulse voltage corresponding to a voltage level of the eleventh node K, to which the third output signal terminal is connected. Accordingly, the (n+1)-th third output signal GW[n+1] is output as a pulse voltage at a low level based on the second clock signal clk2 applied to a source electrode of the twenty-second transistor M22 connected to the eleventh node K at the fourth time point tp4.

Referring to FIG. 6, through the drive procedure described above, the shift registers of an exemplary embodiment of the driving apparatus generate and outputs a plurality of first output signals EM[n], EM[n+1], EM[n+2] and the like, a plurality of second output signals Gl[n], Gl[n+1], Gl[n+2] and the like, and a plurality of third output signals GW[n], GW[n+1], GW[n+2] and the like for every one horizontal period 1H on a stage-by-stage basis.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A driving apparatus comprising:

a plurality of shift registers disposed at a plurality of stages, respectively, wherein each of the shift registers comprises:

a first driver which generates an intermediate output signal and a first output signal based on a first signal, wherein the first driver comprises:

an input signal terminal, to which the first signal is applied; and an inversion input signal terminal, to which a second signal, which is an inverted signal of the first signal, is applied; and a second driver which receives the first output signal and generates a second driver output signal having a pulse voltage at a first level based on the first output signal and a pulse voltage at a second level based on a first clock signal or a second clock signal, wherein the first signal comprises a first input signal, a second input signal, a first inversion input signal, which is an inverted signal of the first input signal, and a second inversion input signal, which is an inverted signal of the second input signal.

2. The driving apparatus of claim 1, wherein a pulse signal of the intermediate output signal and a pulse signal of the first output signal are inverted to each other, and the pulse voltage of the first output signal is substantially equal to a pulse voltage of the first signal.

3. The driving apparatus of claim 1, wherein the first input signal, the second input signal, the first inversion input signal and the second inversion input signal are input to input signal terminals of four consecutive stages of the shift registers, respectively.

4. The driving apparatus of claim 3, wherein inversion input signal terminals of the four consecutive stages of the shift registers receive the first inversion input signal, the second inversion input signal, the first input signal and the second input signal, respectively.

5. The driving apparatus of claim 1, wherein the intermediate output signal of a shift register at a stage of the stages is transferred to the first driver of a shift register at a second next stage of the stages in a forward drive of the shift registers.

6. The driving apparatus of claim 1, wherein the intermediate output signal of a shift register at a stage of the stages is transferred to the first driver of a shift register at a second previous stage of the stages in a backward drive of the shift registers.

7. The driving apparatus of claim 1, wherein the first level is a predetermined high level, and the second level is a predetermined low level.

8. The driving apparatus of claim 1, wherein the second driver output signal comprises:

a second output signal having the pulse voltage at the second level based on one of the first clock signal and the second clock signal; and a third output signal having the pulse voltage at the second level based on the other of the first clock signal and the second clock signal.

9. The driving apparatus of claim 8, wherein the second output signal of a shift register at a stage of the stages is transferred to the second driver of a shift register at a next stage of the stages in a forward drive of the shift registers.

10. The driving apparatus of claim 8, wherein the second output signal of a shift register at a stage of the stages is transferred to the second driver of a shift register at a previous stage of the stages in a forward drive of the shift registers.

11. The driving apparatus of claim 1, wherein a first control signal which controls a forward drive of the shift registers, is input to the first driver, and a second control signal which controls a backward drive of the shift registers and is an inverted signal of the first control signal, is input to the second driver.

12. The driving apparatus of claim 1, wherein the first output signal controls the pulse voltage at the first level of the second driver output signal, and has a voltage level corresponding to a gate-on voltage level of a transistor in the second driver.

13. The driving apparatus of claim 1, wherein the first driver further comprises:

a first control signal terminal, to which a first control signal, which controls a forward drive of the shift registers, is applied;

a second control signal terminal, to which a second control signal, which control a backward drive of the shift registers, is applied, a first forward driving signal terminal, to which a forward start signal of the first driver or the intermediate output signal of a second previous stage is applied, and a first backward driving signal terminal, to which a backward start signal of the first driver or the intermediate output signal of a second next stage is applied; and the second driver comprises:

a first clock signal clock terminal, to which one of the first clock signal and the second clock signal is applied;

a second clock signal terminal, to which the other of the first clock signal and the second clock signal is applied;

the first control signal terminal;

the second control signal terminal;

a second forward driving signal terminal, to which the forward start signal of the second driver or the second driver output signal of the second driver at a first previous stage is applied; and a second backward driving signal to which a backward start signal of the second driver or the second driver output signal of the second driver at a first next stage is applied.

14. The driving apparatus of claim 13, wherein the first driver further comprises a retain signal terminal, to which a retain signal, which controls a transfer of a predetermined bias voltage to a gate electrode of a transistor of the first driver, is applied.

15. The driving apparatus of claim 14, wherein the predetermined bias voltage comprises a power source voltage with a high potential or a low potential.

16. The driving apparatus of claim 13, wherein the first driver further comprises:

a first switch which transfers a pulse voltage of the forward start signal of the first driver or the intermediate output signal at the second previous stage based on the first control signal;

a second switch which transfers a pulse voltage of the backward start signal of the first driver or the intermediate output signal at the second next stage based on the first control signal;

a third switch connected to a first common node, to which the first switch and the second switch are connected, and which transfers a signal applied to the first common node to a first node based on the first signal;

a fourth switch which transfers a first power source voltage at a predetermined high potential to a second node based on the first signal;

a fifth switch which transfers the pulse voltage of the second signal to the second node based on the voltage transferred to the first common node;

a sixth switch which transfers the first power source voltage to a third node based on the voltage transferred to the second node;

a seventh switch which transfers a second power source voltage at a predetermined low potential to the third node based on the first signal;

an eighth switch which transfers the first power source voltage to a fourth node based on the voltage transferred to the third node;

a ninth switch which transfers the second power source voltage to the fourth node based on the voltage transferred to the second node;

a tenth switch which transfer the first power source voltage to a fifth node based on the voltage transferred to the fourth node;

an eleventh switch which transfers the second power source voltage to the fifth node based on the voltage transferred to the third node;

a first capacitor connected between the first node and the second node; and a second capacitor connected between the third node and the fifth node.

17. The driving apparatus of claim 16, wherein the first driver further comprises an intermediate output signal terminal connected to the fourth node and which outputs the intermediate output signal of the first driver.

18. The driving apparatus of claim 16, wherein the first driver further comprises at least one of a twelfth switch which transfers the first power source voltage to the first node based on a retain signal, a thirteenth switch which transfers the second power source voltage to the second node based on the retain signal, and a fourteenth switch which transfers the first power source voltage to the fifth node based on the retain signal.

19. The driving apparatus of claim 13, wherein the second driver comprises:

a fifteenth switch which transfers a pulse voltage of the forward start signal of the second driver or the second driver output signal of the second driver at the first previous stage based on the first control signal;

a sixteenth switch which transfers a pulse voltage of the backward start signal of the second driver or the second driver output signal of the second driver at the first next stage based on the second control signal;

a seventeenth switch connected to a second common node, to which the fifteenth switch and the sixteenth switch are connected, and which transfers a voltage applied to the second common node to a sixth node based on the clock signal applied to the first clock signal terminal;

an eighteenth switch which transfers the first power source voltage at a predetermined high potential to a seventh node based on the first output signal output from the first driver;

a nineteenth switch which transfers the pulse voltage of the clock signal applied to the second clock signal terminal to the seventh node based on the voltage transferred to the sixth node;

a twentieth switch which transfers the voltage transferred to the seventh node to an eighth node based on the clock signal applied to the second clock signal;

a twenty-first switch which transfers the first power source voltage to the ninth node based on the first output signal output from the first driver;

a twenty-second switch which transfers a pulse voltage of the clock signal applied to the first clock signal to a ninth node based on the voltage transferred to the eighth node;

a third capacitor connected between the sixth node and the seventh node; and a fourth capacitor connected between the eighth node and the ninth node.

20. The driving apparatus of claim 19, wherein the second driver further comprises an output signal terminal connected to the seventh node and which outputs the second driver output signal having the pulse voltage at the second level based on the first clock signal.

21. The driving apparatus of claim 19, wherein the second driver further comprises an output signal terminal connected to the seventh node and which outputs the second driver output signal having the pulse voltage at the first level and the pulse voltage at the second level based on to the first clock signal, and the pulse voltage of the second driver output signal at the first level is generated from the eighteenth switch.

22. The driving apparatus of claim 19, wherein the second driver further comprises an output signal terminal connected to the ninth node and which outputs the second driver output signal having the pulse voltage at the second level based on the second clock signal.

23. The driving apparatus of claim 19, wherein the second driver further comprises an output signal terminal connected to the seventh node and which outputs the second driver output signal having the pulse voltage at the first level and the pulse voltage at the second level based on to the second clock signal, and the pulse voltage of the second driver output signal at the first level is generated from the twenty-first switch.

24. A display device comprising:

a display unit comprising:

a plurality of first gate lines to which a plurality of first gate signals are transferred;

a plurality of second gate lines to which a plurality of second gate signals are transferred;

a plurality of light emission control lines to which a plurality of light emission control signals are transferred;

a plurality of data lines to which a plurality of data signals are transferred; and a plurality of pixels connected to the first gate lines, the second gate lines, the light emission control lines and the data lines;

an integral driver which generates and transfers the first gate signals, the second gate signals and the light emission control signals to the pixels, respectively;

a data driver which generates and transfers the data signals to the data lines; and a timing controller which controls the integral driver and the data driver, wherein the integral driver comprises a plurality of shift registers, wherein each of the shift registers comprises:

a first driver which generates an intermediate output signal and a first output signal based on a first signal from the timing controller, wherein the first driver comprises:

an input signal terminal, to which the first signal is applied; and an inversion input signal terminal, to which a second signal, which is an inverted signal of the first signal, is applied; and a second driver which receives the first output signal and generates a first gate signal, which corresponds thereto among the first gate signals, and a second gate signal, which corresponds thereto among the second gate signals, wherein each of the first gate signal and the second gate signal has a pulse voltage at a first level controlled based on the first output signal and a pulse voltage at a second level based on a first clock signal or a second clock signal.

25. The display device of claim 24, wherein a pulse signal of the intermediate output signal and a pulse signal of the first output signal are inverted to each other, and the pulse voltage of the first output signal is substantially equal to the pulse voltage of the first signal.

26. The display device of claim 24, wherein the first signal comprises a first input signal, a second input signal, a first inversion input signal, which is an inverted signal of the first input signal, and a second inversion input signal, which is an inverted signal of the second input signal, and the first input signal, the second input signal, the first inversion input signal and the second inversion input signal are input to input signal terminals of four consecutive stages of the shift registers, respectively.

27. The display device of claim 26, wherein inversion input signal terminals of the four consecutive stages of the shift registers receive the first inversion input signal, the second inversion input signal, the first input signal and the second input signal, respectively.

28. The display device of claim 24, wherein the intermediate output signal of a shift register at a stage of the stages is transferred to the first driver of a shift register at a second next stage of the stages in a forward drive of the shift registers.

29. The display device of claim 24, wherein the intermediate output signal of a shift register at a stage of the stages is transferred to the first driver of a shift register at a second previous stage of the stages in a backward drive of the shift registers.

30. The display device of claim 24, wherein the first level is a predetermined high level, and the second level is a predetermined low level.

31. The display device of claim 24, wherein the first and second gate signals generated in one of two consecutive stages of the stages have pulse voltages at the second level corresponding to the first clock signal and the second clock signal, respectively, the first and second gate signals generated in the other of two consecutive stages of the stages have pulse voltages at the second level corresponding to the second clock signal and the first clock signal, respectively, and the first gate signal and the second gate signal output from the second driver are controlled based on pulse widths or time periods of the first clock signal or the second clock signal.

32. The display device of claim 31, wherein the first gate signal and the second gate signal of a same stage of the stages have a phase difference by a pulse period of the first clock signal and the second clock signal.

33. The display device of claim 24, wherein the first gate signal from a shift register at a stage is transferred to the second driver of a shift register at a first next stage in a forward drive of the shift registers.

34. The display device of claim 24, wherein the first gate signal from a shift register at a stage is transferred to the second driver of a shift register at a first previous stage in a backward drive of the shift registers.

35. The display device of claim 24, wherein the first output signal is output from the first driver as a light emission control signal of the light emission control signals, and the first output signal, which controls the pulse voltage at the first level of the first gate signal and the second gate signal, is transferred to the second driver, wherein the first output signal has a pulse voltage at a level corresponding to a gate-on voltage level of a transistor of the second driver.

36. The display device of claim 24, wherein each of the first driver and the second driver comprises a plurality of transistors, and the transistors comprise a p-type metal oxide semiconductor transistor or an n-type metal oxide semiconductor transistor.

* * * * *